US007383653B1

(12) United States Patent
Hiromori

(10) Patent No.: US 7,383,653 B1
(45) Date of Patent: Jun. 10, 2008

(54) MAGNET DEVICE

(75) Inventor: Junji Hiromori, Tokyo (JP)

(73) Assignee: Hiromori Corporation, Tokyo (JP)

( * ) Notice: Subject to any disclaimer, the term of this patent is extended or adjusted under 35 U.S.C. 154(b) by 278 days.

(21) Appl. No.: 11/093,553

(22) Filed: Mar. 30, 2005

(51) Int. Cl.
*G09F 3/18* (2006.01)

(52) U.S. Cl. ..... 40/661.01; 335/302

(58) Field of Classification Search ..... 40/312, 40/661, 661.01, 711, 600; 446/92; 335/302
See application file for complete search history.

(56) References Cited

U.S. PATENT DOCUMENTS

| | | | | |
|---|---|---|---|---|
| 2,524,548 | A | 10/1950 | Sinclaire | |
| 2,570,625 | A | 10/1951 | Zimmerman et al. | |
| 2,665,912 | A | 1/1954 | Juran | |
| 3,254,440 | A | 6/1966 | Duggar | |
| 3,601,921 | A | 8/1971 | Strohmaier | |
| 4,741,534 | A | 5/1988 | Rogahn | |
| 4,822,044 | A | 4/1989 | Perkitny | |
| 5,347,253 | A | 9/1994 | Ogikubo | |
| 5,409,236 | A | 4/1995 | Therrien | |
| 6,024,626 | A | 2/2000 | Mendelsohn | |
| 6,256,914 | B1 * | 7/2001 | Yeh | 40/720 |
| 6,302,363 | B1 | 10/2001 | Olson et al. | |
| 6,400,247 | B1 | 6/2002 | King | |
| 6,508,904 | B1 | 1/2003 | Charley | |
| 2004/0021052 | A1 * | 2/2004 | Dagan | 248/441.1 |
| 2005/0035837 | A1 | 2/2005 | Yamazaki et al. | |
| 2006/0240737 | A1 * | 10/2006 | Yoon | 446/92 |

* cited by examiner

*Primary Examiner*—Gary C. Hoge
(74) *Attorney, Agent, or Firm*—Dilworth & Barrese LLP.

(57) ABSTRACT

A device for magnetically adhering to an external surface includes one or more magnets placed in a storage chamber. The magnet(s) always remain oriented to adhere to the external surface in any position of the device.

18 Claims, 4 Drawing Sheets

MAGNET DEVICE

BACKGROUND OF THE INVENTION

1. Field of the Invention

This invention relates generally to decorative magnets, and more particularly to a multi-magnet novelty device capable of carrying signs, advertisement displays, and interchangeable displays, on all of the device's curved surfaces.

2. Description of the Related Art

The prior art includes devices that employ magnets arranged inside structures. For example, U.S. Pat. No. 5,347,253 discloses a block that includes a magnet body inside. U.S. Pat. No. 4,741,534 discloses a block that includes a metal ball inside, that ball being attracted to magnetic objects. Furthermore, it is known, for example, to provide "refrigerator" magnets to secure pieces of paper to a metal surface.

U.S. application Ser. No. 10/642,312 filed Aug. 15, 2003, the contents of which are incorporated by reference herein, discloses various embodiments of devices containing permanent magnets and in various polygonal shapes, whereby the respective devices can adhere to an outer magnetic/magnetizable surface to display decorative patterns and/or lettering imprinted thereon. U.S. application Ser. No. 10/836,035 filed Apr. 30, 2004, the contents of which are incorporated by reference herein, discloses a device for adhering to a magnetizable surface and including both a magnet adjustably positioned therein and means for orienting the magnet to face an outer surface of the device and thereby adhere the device to the magnetizable surface when placed adjacent to the same.

It has now been found possible to improve magnetic adherence of such devices to outer magnetic/magnetizable surfaces such as refrigerator doors, regardless of the position or orientation of the magnet(s) within such devices. For example, it is no longer necessary to either jiggle or shake such devices adjacent the outer surface(s) to ensure proper orientation for magnetic adherence, or fix the magnet at a particular orientation within the device to ensure magnetic adherence.

SUMMARY OF THE INVENTION

Accordingly, it is an object of the present invention to improve magnetic attraction between two surfaces.

It is also an object of the present invention to improve reliability of magnetic attraction between two surfaces.

It is another object of the present invention to facilitate retention and positioning of a device against an outer surface, e.g., by magnetic attraction, and improve reliability of such retention.

It is still another object of the present invention to provide an improved miniature, curved-sided, decorative magnet device.

It is a further object of the present invention to provide an improved miniature, curved-sided, decorative magnet device of novel construction for use as a paperweight.

It is yet a further object of the present invention is to provide a decorative magnet device in the form of a cylinder that includes at least one variably shaped magnet.

It is even another object of the present invention to facilitate retention of a device containing a magnet against outer magnetic or magnetizable surface, regardless of the orientation or positioning of the magnet within the device.

These and other objects are accomplished by the present invention which is directed to a device for adhering to a magnetic or magnetizable surface and comprising a chamber structured and arranged for containing at least one permanent magnet therein, a magnet adjustably positioned within the chamber which also has a curved outer circumferential surface and being structured and arranged to contain the magnet such that any position or orientation of the magnet within the chamber will adhere the device to the magnetic or magnetizable surface at any point along the curved outer circumferential surface of the chamber.

The inventive device provides secure, reliable attachment to an external magnetic or magnetizable surface when brought close thereto, regardless of particular orientation of the magnet contained within the device. There is no longer any need to either shake or jiggle the device to properly orient the magnet or provide means for maintaining the make in specific orientation or position within the device, so the emanating flux lines are directed towards the external surface. The device and magnet are both structured and arranged such that the emanating lines of flux will always be directed to the external surface when the device is brought close and securely adhere the device to the external surface, even through a curved outer circumferential surface of the device which can either be substantially cylindrically or elliptically-shaped.

The magnet itself can be in the shape of a rectangular parallelepiped, i.e., prism, or a cylinder. Due to the emanating lines of flux which are always directed from the magnet to the external surface, the device can be retained upon the abutting external surface at any arbitrary point over a 360° circumference of the device. As the magnet, e.g., slides along an inner side of the circumferential surface of the device, orientation of the magnetic flux emanating from the north and south poles of the magnet always faces the external surface and with relative distance between the contained magnet and external surface shortened over prior art devices, thus enhancing magnetic attraction and retention of the device.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Figure 1A:
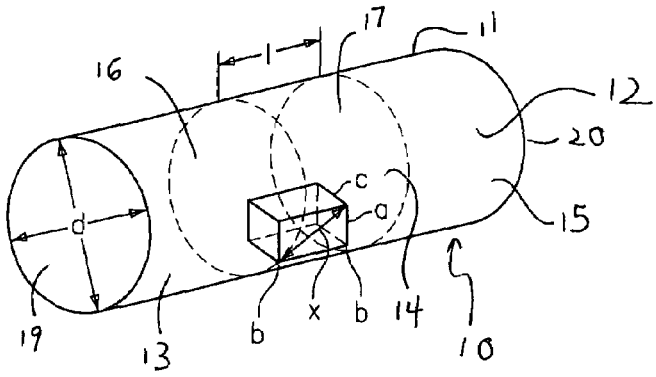
FIG. 1*a* is a perspective view of a cylindrically-shaped magnet device in accordance with the present invention.
Figure 2A:
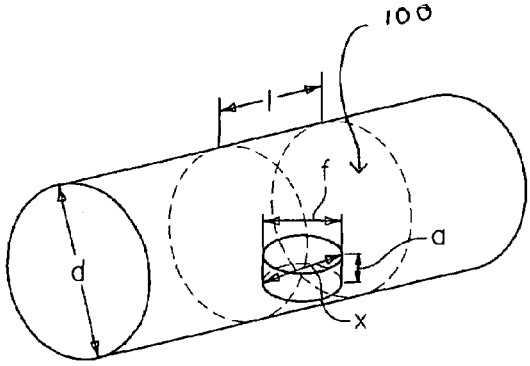
FIG. 2*a* is a perspective view of a cylindrically-shaped magnet device similar to FIG. 1 and illustrating a cylindrically-shaped magnet contained therewithin.

Referring to the drawings in the present application in which similar components have been denoted by the same reference numerals, FIGS. 1*a* and 2*a* illustrated one embodiment of the device 10 substantially in the shape of a hollow spindle or cylinder and constructed, e.g., from transparent plastic. A curved surface 12 of the cylindrical magnet device 10 can be used to display signs or pictures. Those signs or pictures can be painted or glued to the surface 12 of the cylindrical magnet device 10. Similarly, interchangeable magnetically attractive sign or picture plates, made of magnetic or magnetically attractive material, can be connected to the surface of the inventive device. Because of its magnetic nature, the inventive device 10 can be used for display purposes or to hold papers, photographs, and other thin items against any magnetically attractive surface, for example a refrigerator or clipboard.

In the illustrated embodiment, the inventive device 10 includes a prismatic, i.e., rectangular parallelepiped, magnet 20, a cylindrical body 11, a storage chamber portion 100 for containing the magnet 20 and two inner chambers 13, 15 of the cylindrical body 10 for containing, e.g., items such as character goods. The inventive device is shown with a curved outer circumferential surface 12, two inner partitions 16, 17 bordering storage chamber 100 and two end walls 19, 21 of the cylinder. The storage portion 100 encloses the magnet 20 and is also cylindrical in shape. The outer surface of the cylindrical body 11 is transparent or semitransparent so that novelty items such as character goods placed in outer compartments 13 and 15 can be seen. Images such as letters and/or patterns for advertisement can be printed on the outer surface 12 of the cylindrical body 10. Various items, solids, liquids, and gases, may be placed into the outer compartments 13, 15 for observation. It is preferred such items are non-magnetically attractive, however, magnetically-attractive items may also be used.

In the embodiment illustrated in FIGS. 1*a* and 2*a*, the end walls 19 are of circular shape. However, it is within the preview of the present invention, to shape end walls 19, e.g., as a triangle, tetragon, oval, square, rectangle, pentagon, hexagon, star, or any other acceptable shape. Additionally, the compartments 13, 15 and storage chamber 100 can be made in varying sizes.

In the present example, the inventive device is formed of light transparent material such as plastic, however, other materials that are not magnetically attractive may be used. The magnet 20 must possess a sufficient magnetic force to attract magnetic or magnetically attractive sign plates to sides of the magnet device or hold the device 10 affixed to a magnetically attractive surface along the curved circumferential surface 12. The magnet 20 is allowed to move freely along an inner side of the storage chamber 100, so that at any point along the circumferential surface 12, the device 10 may adhere to the external surface. The storage chamber 100 itself may take any shape, e.g., oval, circular or rectangular. Similarly, the magnet 20 may be of any shape. For example, the magnet can be flat circular, flat rectangular, cubic or rectangular.

In this regard, as pointed out supra, the storage chamber 100 and magnet 20 are structured and arranged such that any orientation or position of the magnet 20 within the chamber 100 will magnetically adhere the device 10 to an outer external magnetic or magnetizable surface if any point over a 360° circumference of the surface 12 is brought into contact with the external surface. In particular, magnetic lines of flux emanating from the north and south poles of the magnet 20 always face the external surface, thereby ensuring secure attachment upon contact with the device 10.

Figure 1B:
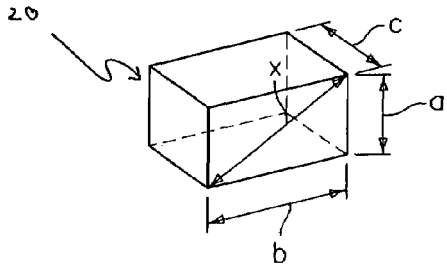
FIG. 1*b* is a perspective view of the prismatically-shaped magnet shown in the cylindrically-shaped device illustrated in FIG. 1*a;*

In the embodiment of the present invention illustrated in FIGS. 1*a* and 1*b*, the inventive device 10 incorporates a prismatically-shaped magnet 20 where a denotes a thickness of the prismatic magnet 20, b denotes a length of the magnet 20, c denotes width and x denotes a diagonal length of the magnet 20 and which is a hypotenuse of a right triangle. The length l of the storage chamber 100 of the cylindrical body 10 is larger than the length b of the prismatic magnet 20 but is smaller than the diagonal length x of the magnet 20; the width c of the prismatic magnet 20 is preferably equal to or less than one half the inner diameter d of the cylindrical body 10. These dimensions shorten relative distance between the magnet 20 and the external metallic surface. Rotation of the magnet 20 in the storage chamber 100 is controlled so that the magnet 20 can move along an inner side of the circumferential surface 12 while orientation of magnetic flux at north pole and south poles of the magnet 20 always faces the external metallic surface.

In this regard, the thickness a can be smaller than the length b and the width c, with both the length b and width c equal to or less than one-half the inner diameter d of the cylindrical body 10.

Figure 2B:
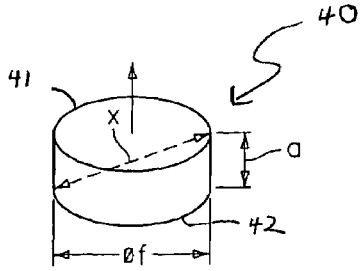
FIG. 2*b* is a perspective view of the cylindrically-shaped magnet shown in the device illustrated in FIG. 2*a;*

In an alternative embodiment of the present invention illustrated in FIGS. 2*a* and 2*b*, the inventive device 10 incorporates a cylindrically-shaped magnet 40 where f denotes a diameter of the cylindrical magnet 40 between end surfaces 41 and 42, a denotes thickness of the magnet 40, and x denotes a diagonal length of the magnet 40 between end surfaces 41 and 42 and which is derived from the equation $x=\sqrt{(f^2+a^2)}$. The length l of the storage chamber 100 of the cylindrical body 10 is larger than the diameter f of the cylindrical magnet 40 but smaller than the diagonal length x of the magnet 40, while the diameter f of the cylindrical magnet 40 is equal to or less than one half of the inner diameter d of the cylindrical body 10, also shortening relative distance between the magnet 40 and external metallic surface. The thickness a is also smaller than the diameter f. Rotation of the magnet 40 within the storage chamber 100 is controlled so that the magnet 40 can move along the inside of the circumferential surface 12 while orientation of magnetic flux at north and south poles of the magnet 40 always faces the external metallic surface.

Figure 3:
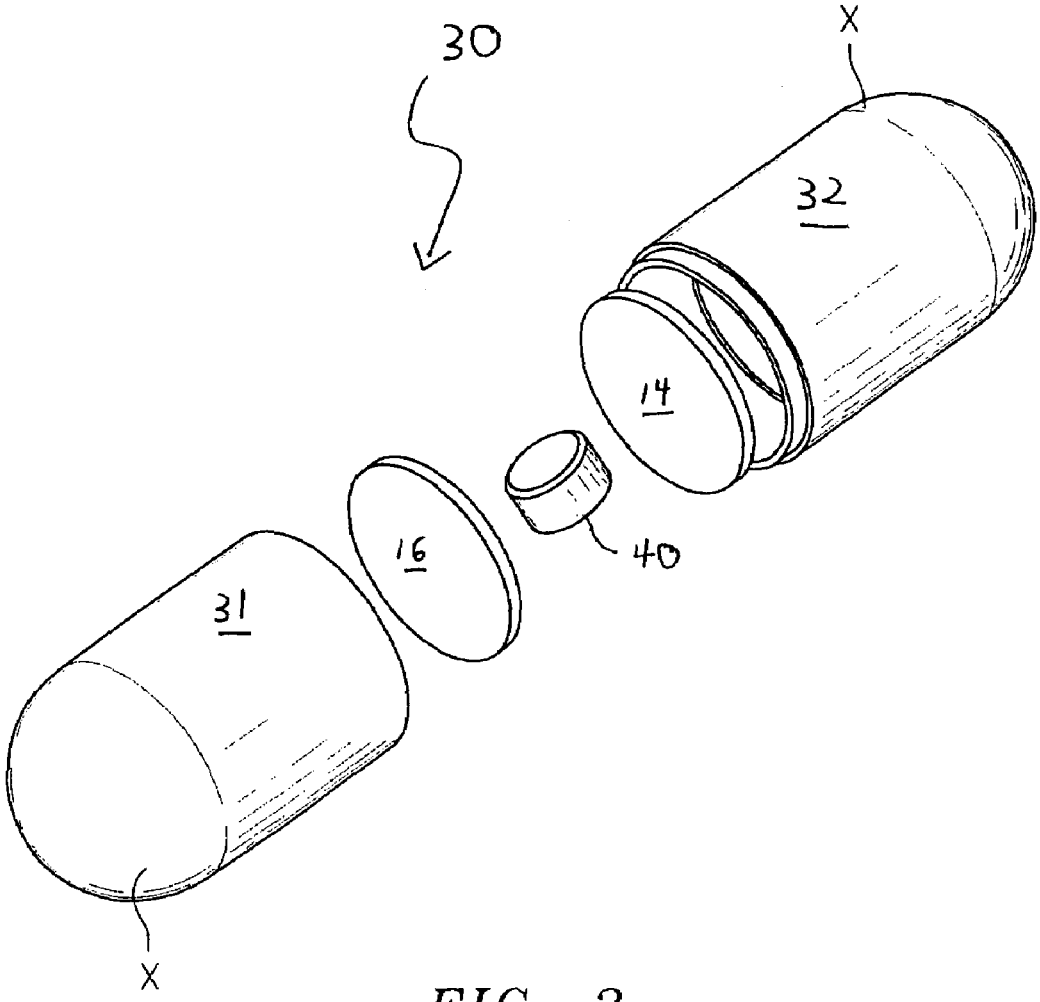
FIG. 3 is an exploded perspective view of an alternative embodiment of the inventive device in elliptical form.
Figure 4A:
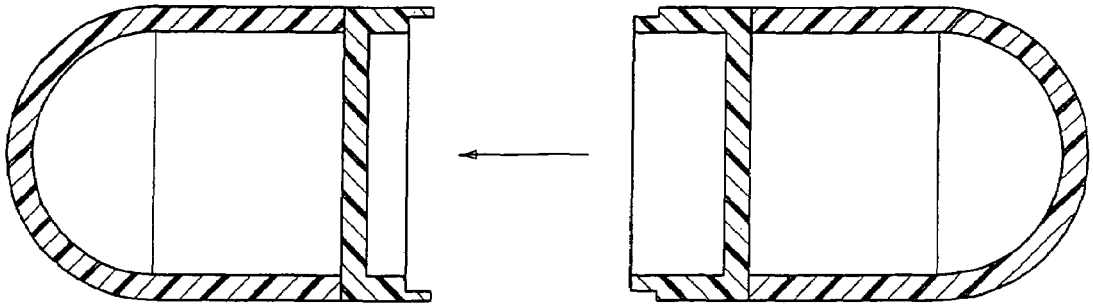
FIG. 4*a* is a sectional view similar to FIG. 4*b* infra of an alternative embodiment of the inventive device.
Figure 4B:
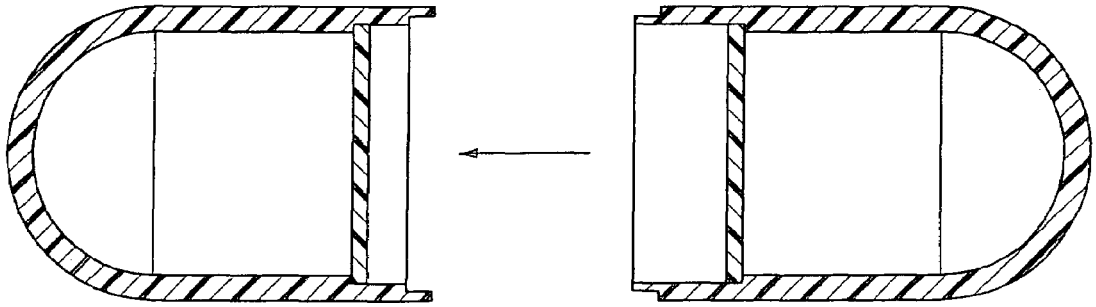
FIG. 4*b* is a sectional view of the inventive device shown in FIG. 3, prior to assembly.

The device according to the present invention may also be elliptically-shaped as shown in FIGS. 3 and 4*a-c*, with rounded ends x. These figures also illustrate assembly of various embodiments of the inventive device which are also applicable to the cylindrically-shaped embodiment shown in FIGS. 1*a* and 2*a* supra. More particularly, FIGS. 3 and 4*b* illustrate an embodiment in which respective end portions 31, 32 are each provided with a partition 16, 14 seating along a respective inner step and then coupled together in the direction of the arrow in FIG. 4*b* to define the storage chamber therebetween. The magnet, e.g., cylindrical magnet 40 is concomitantly positioned between the partitions before the end pieces are coupled together. In an alternative embodiment illustrated in FIG. 4*a*, both end pieces are provided with integral portions defining the sides of storage chamber 12 when brought together in the direction of the arrow, so there is no need to provide separate partitions. In other words, the inventive device is assembled just by coupling frames of the end portions together.

Figure 4C:
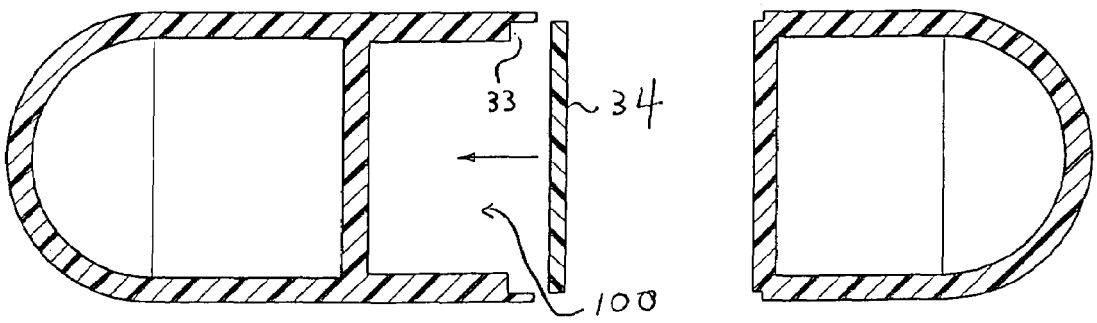
FIG. 4*c* is a sectional view similar to FIG. 4*b* supra of an alternative embodiment of the inventive device.

Furthermore, in an alternative embodiment illustrated in FIG. 4*c*, one of the end portions comprises an inner wall defining one end of the storage chamber and also a seat 33 to receive a partition 34 upon assembly, in the direction of the arrow. The other end portion is coupled to the first end portion. In this embodiment, the inner storage chamber 100 is essentially located in just one of the end portions upon assembly.

Figure 5A:
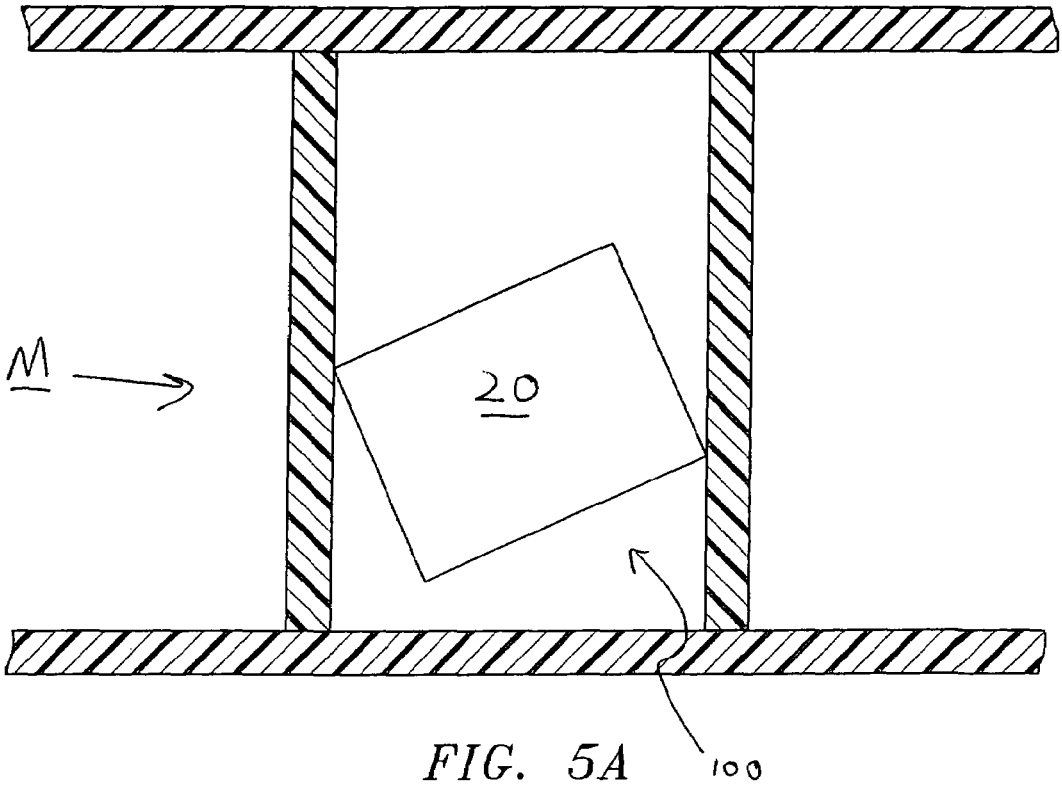
FIG. 5*a* is a partially schematic sectional view of the inventive device and illustrating positioning of a magnet therein.
Figure 5B:
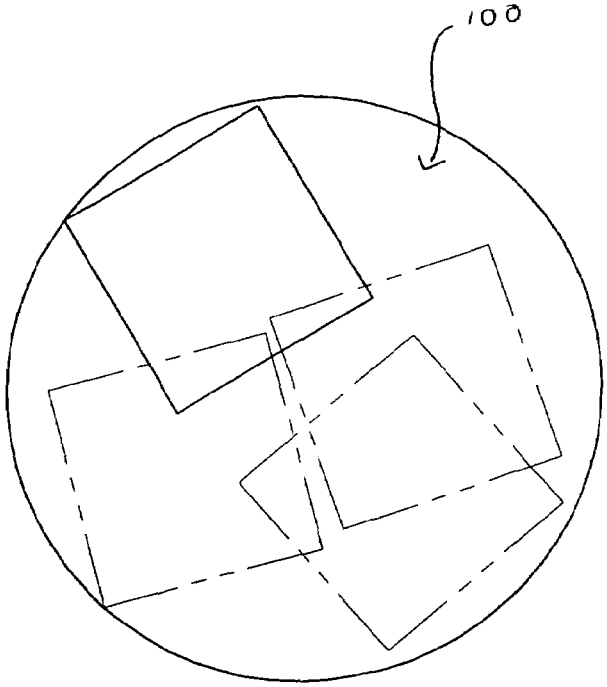
FIG. 5*b* is a schematic end view in the direction of arrow M in FIG. 5*a* and illustrating various positions of the magnet in accordance with the present invention.

FIGS. 5*a* and 5*b* schematically illustrate orientation of a prismatic magnet 20 within the storage chamber so that emanating magnetic lines of force always face an external metallic surface when placed nearby. In particular, FIG. 5*b* schematically illustrates movement of the magnet 20 within the storage chamber 100, all while maintaining orientation of the magnetic flux lines.

The above described inventive device and its variations can also be used as a paperweight or paper holder, a refrigerator magnet, and an advertising device, wherein copies for advertisement can be affixed to surfaces of the main body. A magnetic banner may be connected to the device, and a sign may be painted or glued to the device. Furthermore, novelty items may be placed in the compartments bordering the storage chamber 100 for viewing or making sounds.

The above description is given by way of example only. Changes in form and details may be made by one skilled in the art without departing from the scope of the invention as defined by the appended claims.

What is claimed is:

1. A device for adhering to an external magnetic or magnetizable surface, comprising a chamber structured and arranged for containing at least one permanent magnet therein, a magnet adjustably positioned within said chamber, said chamber comprising a curved outer circumferential surface, and said chamber structured and arranged to contain said magnet such that any position or orientation of said magnet within said chamber will adhere said device to the magnetic or magnetizable surface when brought close to the magnetic or magnetizable surface at any point along said curved outer circumferential surface of said chamber, wherein said magnet is substantially in the shape of a rectangular parallelepiped or prism, and said chamber comprises a length (l) larger than a length (b) and smaller than a diagonal length (x) of said magnet.

2. The device of claim 1, wherein said outer circumferential surface is curved over the entire length thereof, and said magnet is positioned within said chamber such that lines of force always emanate from said magnet to said curved outer circumferential surface of said chamber at any position or orientation of said magnet within said chamber.

3. The device of claim 2, wherein said chamber comprises a width always maintained substantially perpendicular to the magnetic/magnetizable surface when said device is brought close to this surface.

4. The device of claim 2, structured and arranged to allow said magnet to move along an inner side of said outer circumferential surface and assume any position or orientation within said chamber, with direction of flux from said magnet being maintained and directed to the magnetic or magnetizable surface when said device is brought close thereto.

5. The device of claim 4, comprising a plurality of magnets stacked together.

6. The device of claim 1, wherein said magnet additionally comprises a width (c) equal to or less than one half an inner diameter (d) of said chamber.

7. The device of claim 6, wherein said magnet additionally comprises a thickness (a) smaller than the length (b) and width (c) thereof.

8. The device of claim 7, wherein the length (b) of the magnet is equal to or less than one half the inner diameter (d) of said chamber.

9. The device of claim 1, additionally comprising partitions respectively fit at opposite ends of said chamber to enclose said magnet therewithin.

10. The device of claim 1, comprising a main body and cover body, said main body provided with an interior step, a partition arranged to seat against said step and define one end of said chamber, and a cover body arranged to be secured to said main body and define an opposite end of said chamber.

11. The device of claim 1, comprising two outer frames or portions of a cylindrical main body fit together to define said chamber therebetween.

12. The device of claim 1, substantially in the shape of a cylinder.

13. The device of claim 1, substantially in the shape of an ellipse.

14. The device of claim 1 being in the shape of a substantially cylindrical or elliptical body, with said chamber situated within said body between ends thereof, comprising at least one other compartment separate from said chamber within said device and structured and arranged to contain at least one item, said outer circumferential surface being transparent or semi-transparent to allow the at least one item to be visible, and at least one image being situated upon said outer cylindrical surface.

15. A device for adhering to an external magnetic or magnetizable surface, comprising a chamber structured and arranged for containing at least one permanent magnet therein, a magnet adjustably positioned within said chamber, said chamber comprising a curved outer circumferential surface, said chamber structured and arranged to contain said magnet such that any position or orientation of said magnet within said chamber will adhere said device to the magnetic or magnetizable surface when brought close to the magnetic or magnetizable surface at any point along said curved outer circumferential surface of said chamber, and substantially in the shape of a cylinder and comprising cylindrically-shaped end portions fit on opposite ends of said chamber and respectively comprising partitions fit at opposite ends of said chamber to enclose said magnet therewithin and define two laterally-adjacent chambers devoid of a magnet on opposite sides of said chamber containing said magnet.

16. The device of claim 15, wherein said magnet is substantially cylindrical, and said chamber comprises a length (l) larger than a diameter (f) of said magnet but smaller than a diagonal length (x) of said magnet between end surfaces thereof.

17. The device of claim 16, wherein said magnet comprises a thickness (a) smaller than the diameter (f) thereof and which is equal to or less than one half an inner diameter (d) of said chamber.

18. The device of claim 17, wherein the diagonal length (x) of said magnet is determined according to the following formula:

$$\sqrt{(f^2+a^2)}=x.$$

* * * * *